United States Patent [19]

Heinrich

[11] 4,105,376

[45] Aug. 8, 1978

[54] ROTOR FOR HYDRAULIC PUMP OR MOTOR

[75] Inventor: Allan E. Heinrich, Oconomowoc, Wis.

[73] Assignee: Applied Power, Inc., Milwaukee, Wis.

[21] Appl. No.: 765,311

[22] Filed: Feb. 3, 1977

[51] Int. Cl.[2] ..... F01C 21/00; F03C 3/00

[52] U.S. Cl. ..... 418/77; 418/80; 418/81

[58] Field of Search ..... 418/77, 80, 81

[56] References Cited

U.S. PATENT DOCUMENTS

| | | | |
|---|---|---|---|
| 2,642,802 | 6/1953 | Gardiner | 418/77 |
| 2,820,417 | 1/1958 | Adams et al. | 418/80 |

*Primary Examiner*—John J. Vrablik

*Attorney, Agent, or Firm*—John J. Byrne; Edward E. Dyson

[57] ABSTRACT

A hydraulic vane-type pump or motor comprising a housing and a stator defining a rotor chamber, and a rotor for rotation in said chamber on a shaft extending axially through said housing. To prevent gouging of the walls of the rotor chamber by the sharp peripheral edges of the rotor, the rotor sidewalls are ground or offset in the area of the peripheral edges to provide sufficient clearance between the rotor sidewalls and the chamber walls. The rotor is offset to a lesser depth beginning at a point radially inwardly from the outer peripheral edge toward the center thereof to minimize excessive oil leakage normally associated with rotors which are milled to prevent gouging.

5 Claims, 3 Drawing Figures

ROTOR FOR HYDRAULIC PUMP OR MOTOR

FIELD OF THE INVENTION

This invention relates to a hydraulic pump or motor and more particularly to an improved vane-type hydraulic pump or motor.

BACKGROUND OF THE INVENTION

This invention relates to vane-type hydraulic motors or pumps comprising a housing, and a stator with the housing and stator defining a rotor chamber. The rotor has radially reciprocating vanes around its outer periphery and is rotatably mounted in the chamber on a shaft extending axially through the housing.

It has been found that the sharp peripheral edges of the rotor tend to gouge or bind with the sidewalls of the rotor chamber due to the pressures and shocks under which the pump or motor is operated. These gouges can also be caused by machining inaccuracies in combination with the above. To overcome this, others in the prior art have ground away or offset portions of the opposite sidewalls of the rotor to provide clearance with the sidewalls of the chamber sufficient to minimize or eliminate gouging. However, this greater clearance has enhanced oil leakage. The purpose of this invention is to overcome those problems encountered with respect to oil leakage.

SUMMARY OF THE INVENTION

To minimize oil leakage while at the same time minimizing gouging, the sidewalls of the rotor of this invention are milled or offset to different depths at radially spaced points between the axis and the periphery of the rotor. The sidewalls of the rotor adjacent to the outer periphery edges thereof are offset to the greatest depth, or approximately 0.001 of an inch. At a point spaced radially inwardly from the peripheral edges of the rotor, the sidewalls are milled or offset to a depth of only about 0.0005 inches. The net effect is that the clearance between the peripheral edge portions of the rotor and the sidewalls of the rotor chamber is increased to minimize or preclude gouging and binding. At the same time, to minimize oil leakage, the remaining portions of the sidewalls of the rotor are in closer proximity to the sidewalls of the rotor chamber to significantly narrow potential oil leakage paths.

OBJECTS OF THE INVENTION

Accordingly, an objective of this invention is to provide a rotor structure for a hydraulic pump or motor, constructed in a manner to minimize gouging and binding while also minimizing oil leakage between the sidewalls of the rotor and the sidewalls of the rotor chamber.

A further objection of this invention is to provide a rotor which can be readily structured in accordance with the teachings of this invention by simple and well-known milling processes.

It is a further objective of this invention to provide a rotor structure which will not gouge or bind with the sidewalls of the rotor chamber and which will minimize oil leakage, all without compromising the efficiency of the pump or motor.

These and other objects of the invention will become more apparent to those skilled in the art by reference to the following detailed description when viewed in light of the accompanying drawings wherein:

DETAILED DESCRIPTION OF THE DRAWINGS

Figure 1:
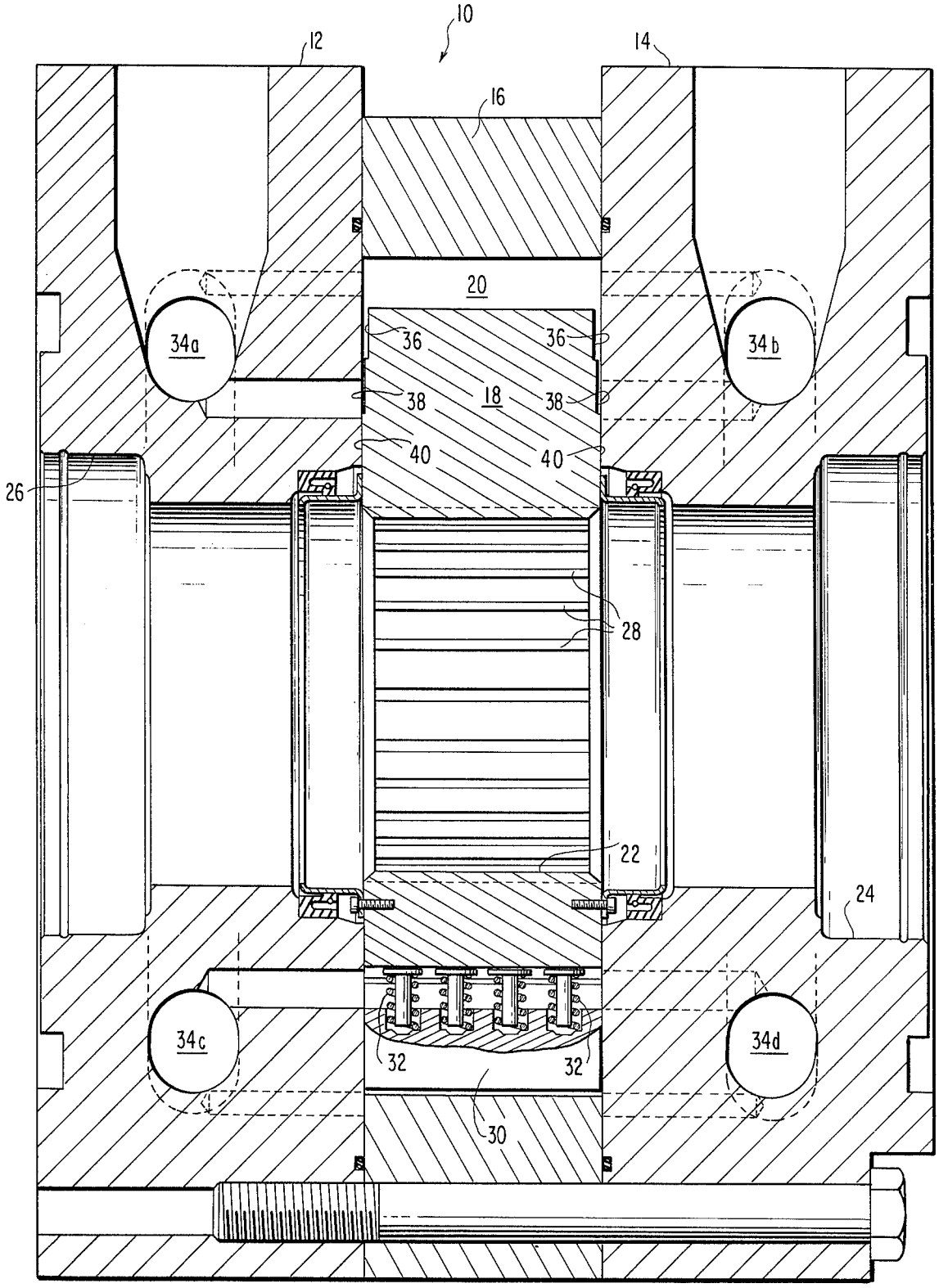
FIG. 1 is a cross sectional view of the hydraulic pump or motor employing the rotor of this invention.

Referring to FIG. 1 wherein like numerals indicate like parts, a conventional hydraulic motor or pump is generally indicated by the numeral 10 and includes end plates 12 and 14, a stator ring 16 and a rotor 18. The invention of this application resides in the structure of the rotor 18. For convenience, the device will be referred to as the motor although it is to be understood that it can be operated either as a motor or as a pump.

The motor is of a reciprocating vane type with the end plates 12 and 14 and the stator ring 16 defining a rotor chamber 20. The rotor 18 is received in the chamber 20 and has a central opening 22 for receiving a shaft (not shown) which extends through openings 24 and 26 in the end plates. The rotor is provided with axially extending splines 28 which mesh with splines on the shaft.

The rotor 18 is provided with radially reciprocating vanes 30, received in slots around its periphery and urged into engagement with the inner wall of the stator ring by means of springs 32. The vanes, along with the rotor, stator ring and sidewalls of the chamber 20, create expansible chambers, which are supplied with fluid under pressure or are exhausted through suitable passageways generally indicated by the numerals 34*a* through 34*d*. The operation and structure of the motor will not be described in detail since it operates in a manner conventional with vane motors.

The novelty of this invention resides in the structure of the rotor 18. As mentioned earlier herein, there is a tendency for the sharp peripheral edges of the rotor to gouge into and bind with the sidewalls of the rotor chamber when in operation. Others in the prior art have attempted to alleviate this problem by offsetting or cutting away a portion of the side walls of the rotor to a point adjacent to the central opening portion of the rotor. It has been found that gouging is substantially minimized if the rotor sidewalls are ground or offset to a depth of approximately 0.001 inches.

However, when the side walls of the rotor are offset as described above, a leakage path is formed resulting in substantial leakage of the hydraulic fluid from the area of the vanes, which in turn means lower motor efficiency. To overcome this problem, this invention provides a rotor which is milled to form a two-step offset.

Referring again to FIG. 1, portions of the sidewalls of the rotor adjacent the peripheral edge thereof, which portions are both identified by the numeral 36, are milled to a depth of approximately 0.001 inches. A short distance radially inward of the outer peripheral edge of the rotor, another portion of each of the sidewalls of the rotor at 38 are milled to a depth of approximately 0.0005 inches or, half of the depth of the milled portions 36. The remaining portions 40 of the sidewalls of the rotor remain of standard size and of close tolerance relative to the side walls of the rotor chamber in order to prevent wobbling of the rotor during rotation and minimize leakage.

By offsetting the rotor sidewalls at two different levels, the width of the leakage path will be substantially lessened, therefore, minimizing leakage and enhancing the operating efficiency of the motor. However, a significant portion of the rotor will still be offset, if in varying degrees, to minimize gouging and binding.

Figure 2:
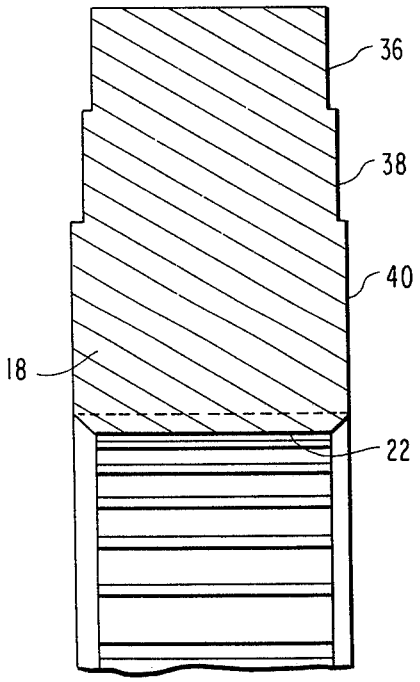
FIG. 2 is a cross sectional view of the rotor of this invention.

The rotor of this invention is more clearly shown in FIG. 2 which is a cross-sectional view of the rotor, only, showing the non-milled portions 40 and the milled portions 38 and 36. The two-step arrangement, of course, is somewhat exaggerated as it is in FIG. 1, for purposes of illustration.

Figure 3:
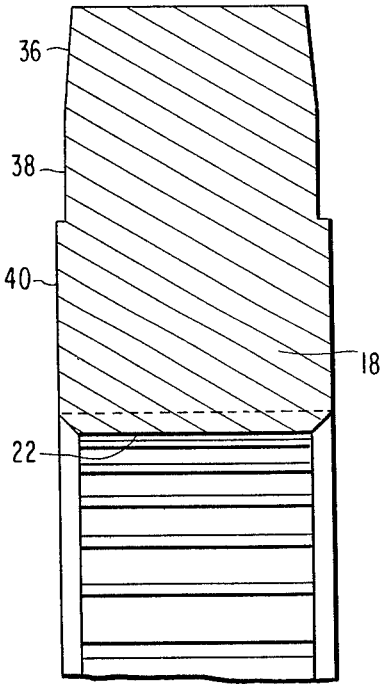
FIG. 3 is a cross sectional view of a modification of the rotor of this invention.

A modified form of the invention is shown in FIG. 3, wherein instead of grinding the portion 36 evenly along the plane perpendicular to the horizontal, the portion 36 is ground to provide a tapered sidewall along that portion. This accomplishes the same purpose of providing a clearance between the sharp edge portions of the rotor relative to the sidewalls of the rotor chamber while at the same time minimizing the leakage path.

In a general manner, while there has been disclosed an effective and efficient embodiment of the invention, it should be well understood that the invention is not limited to such embodiment as there might be changes made in the arrangement, disposition, and form of the parts without departing from the principle of the present invention as comprehended within the scope of the accompanying claims.

I claim:

1. In a fluid pressure motor comprising a rotor having sidewalls and peripheral edge portions, a stator ring surrounding said rotor and defining a plurality of working chambers therewith, slidable vanes received in radial slots in said rotor and normally biased into abutment with said stator ring, a housing for said rotor defining a rotor chamber having sidewall surfaces facing the sidewalls of said rotor, a central axially extending bore in said housing and said rotor and adapted to receive a shaft, for drivingly engaging said rotor with said shaft, fluid inlet and outlet means for communicating with said chambers, the improvement wherein said rotor has two stepped annular offsets in each sidewall of said rotor, the first annular offset extending inwardly from the circumferential edge of said rotor and the second annular offset extending inwardly from the first annular offset, said first offset being just deep enough to provide sufficient clearance between the rotor sidewalls and the chamber sidewalls to prevent gouging of the chamber sidewalls by the peripheral edges of said rotor and said second offset being of a depth less than first offset which is just deep enough to minimize excessive oil leakage normally associated with rotors which are offset to prevent gouging.

2. The motor of claim 1 wherein said offsets on each sidewall of said rotor together cover a major portion of the associated sidewall.

3. The motor of claim 1 wherein said first offset is approximately 0.001 of an inch deep and said second offset is approximately 0.0005 of an inch deep.

4. The motor of claim 1 wherein the bottoms of said first and second offsets are at least approximately parallel to the rotor sidewalls.

5. The motor of claim 1 wherein said first offset is a taper extending from said second offset to the circumferential edge of said rotor.

* * * * *